US008292251B2

(12) United States Patent
Badorini

(10) Patent No.: US 8,292,251 B2
(45) Date of Patent: Oct. 23, 2012

(54) EASEL FOR BINDER

(75) Inventor: Mark Badorini, Cheshire, MA (US)

(73) Assignee: Sampco Companies, Inc., Pittsfield, MA (US)

( * ) Notice: Subject to any disclaimer, the term of this patent is extended or adjusted under 35 U.S.C. 154(b) by 130 days.

(21) Appl. No.: 12/966,176

(22) Filed: Dec. 13, 2010

(65) Prior Publication Data

US 2012/0145870 A1 Jun. 14, 2012

(51) Int. Cl.
*A47B 97/04* (2006.01)

(52) U.S. Cl. ..... 248/460; 248/463; 281/21.1; 402/80 R

(58) Field of Classification Search ..... 248/441.1, 248/442.2, 444, 448, 450, 451, 452, 458, 248/460, 461, 463; 40/124.18, 124.17; 402/19, 402/80 L, 79, 500; 281/38, 21.1
See application file for complete search history.

(56) References Cited

U.S. PATENT DOCUMENTS

| | | | | | |
|---|---|---|---|---|---|
| 871,833 | A | | 11/1907 | Taylor | |
| 1,207,577 | A | | 12/1916 | Loose | |
| 3,065,230 | A | * | 11/1962 | Baltzly et al. | 544/71 |
| 3,913,740 | A | * | 10/1975 | Bisberg | 206/472 |
| 4,552,479 | A | * | 11/1985 | Nickow et al. | 402/74 |
| 4,609,206 | A | * | 9/1986 | O'Brien | 281/33 |
| D341,160 | S | | 11/1993 | Reiseneder | |

* cited by examiner

*Primary Examiner* — A. Joseph Wujciak, III
(74) *Attorney, Agent, or Firm* — 24IP Law Group; Timothy R. Dewitt

(57) ABSTRACT

A folding display easel having left, right and center panels, the right and left panels being foldable toward the center panel. The center panel has a plurality of engagement elements for engaging with rings in a binder for easy storage and removal of easel from the binder.

9 Claims, 4 Drawing Sheets

EASEL FOR BINDER

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The present invention relates to the field of display easels, and more particularly, to display easels that form part of or may be incorporated into ring binders.

2. Brief Description of the Related Art

Many different types of display easels have been suggested for many different applications. Some of those types of display easels have been incorporated into ring binders. For example, U.S. Pat. No. 4,552,479 discloses an easel type binder having front, rear and central binder panels with fold lines running longitudinally the full length of the front and rear binder panels to permit the panels to be folded into a binder-closed position. The binder is provided with a transversely extending fold line which extends across the front, rear and central binder panels to permit the upper portion of each panel to be folded back into an easel providing position. A pair of flaps having locking tabs are provided to "rigidify" the binder in its easel formation. In another example, U.S. Pat. No. D341,160, an extendable support is included on a central portion of a binder such that the support may be folded up when the binder is closed and folded down to a position at a right angle with the central portion of the binder to hold the binder in a standing position. Many other examples of easels can be found, including folding easels such as is disclosed in U.S. Pat. No. 871,833, entitled "Easel and Hanger."

SUMMARY OF THE INVENTION

In a preferred embodiment, the present invention is a folding display easel. The easel comprises a left panel having a base side, right side at substantially a right angle to said base, a top side having a first portion at substantially a right angle to said right side and a second portion angling toward said base side, and a left side having a retention element; a right panel having a base side, left side at substantially a right angle to said base, a top side having a first portion at substantially a right angle to said left side and a second portion angling toward said base side, and a right side having a retention element; a center panel having a base side, a left side, a right side, a top side, a front face and a rear face; a first connecting element connecting said right side of said left panel to said left side of said center panel, said first connecting element permitting said left panel to fold toward said front face of said center panel and resisting said left panel folding toward said rear face of said center panel; a second connecting element connecting said left side of said right panel to said right side of said center panel, said second connecting element permitting said right panel to fold toward said front face of said center panel and resisting said right panel folding toward said rear face of said center panel; a first engagement element formed integrally with said top side of said center panel, wherein said first engagement element engages with a ring when said easel is placed in a ring binder; and a second engagement element formed integrally with said top side of said center panel, wherein said first engagement element engages with a ring when said easel is placed in a ring binder. The easel has a folded position in which a first of said right and left panels is folded to a position adjacent said front face of said center panel and a second of said right and left panels is folded to a position adjacent said first of said right and left panels and said easel has a support position in which said right and left panels are partially folded to positions placing said right and left patent at approximately right angles with said center panel to support a binder resting upon said second portions of said tope sides of said right and left panels and retained on said second portions by said retention elements on said right and left panels.

The first engagement element may comprise a plurality of tabs extending from top side of said center panel. The plurality of tabs comprises a first tab having a neck portion and a tip portion, said tip portion being larger than said neck portion; a second tab having a neck portion and a tip portion, said tip portion being larger than said neck portion; and a third tab having a neck portion and a tip portion, said tip portion being larger than said neck portion. The second tab is between said first tab and said third tab. The first and second tab tips form a channel and said first and second tab necks form a receptacle connected to said channel, said channel being larger than said receptacle. The first tab tip and said second tab tip may have straight edges facing one another, wherein said straight edges form a channel. The straight edges of said first tab tip and said second tab tip may be non-parallel to one another and thereby form a channel that becomes narrower as it gets closer to the receptacle. The second engagement element may be formed spaced apart from the first engagement element and similar to said first engagement element in structure.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which.

DETAILED DESCRIPTION OF THE PREFERRED EMBODIMENTS

Figures 1, 2A, 2B:
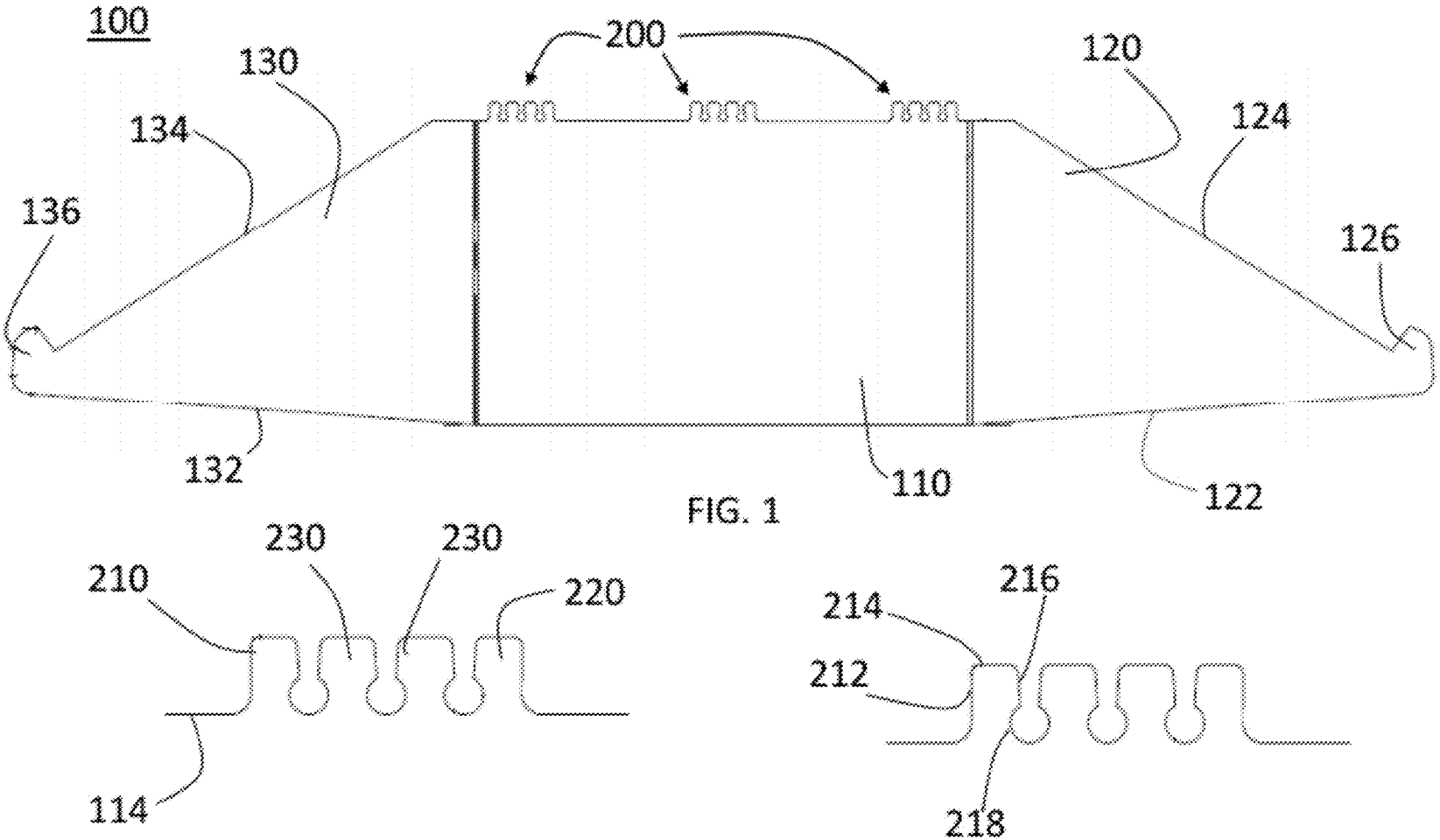
FIG. 1 is a front view of an easel in accordance with a preferred embodiment of the present invention with its side panels in a fully open position.
FIGS. 2A-D are front views of an engagement means for engaging with rings in a binder of an easel in accordance with a preferred embodiment of the present invention.
Figure 3:
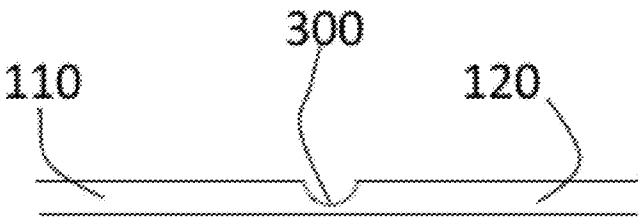
FIG. 3 is an end view of a grooved element between a central panel and a side panel of an easel in accordance with a preferred embodiment of the present invention.
Figure 2C:
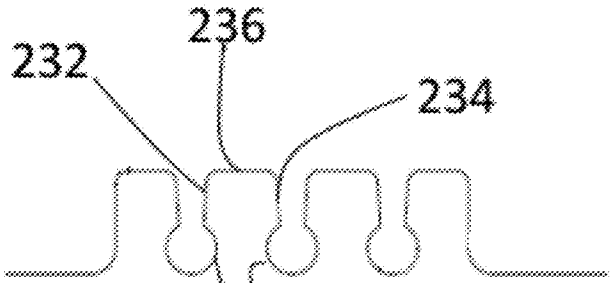
Figure 2D:
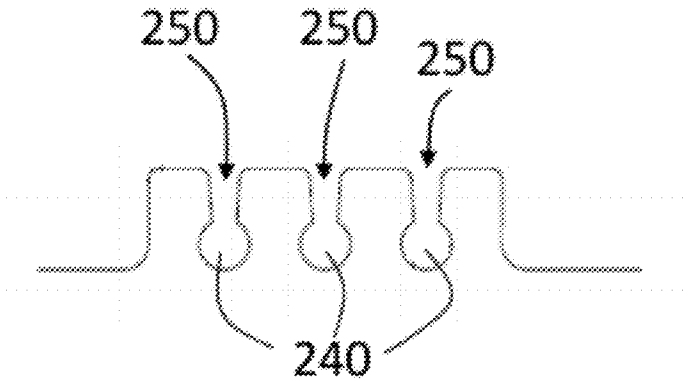

A preferred embodiment of the present invention will be described with reference to FIGS. 1-7. A table top easel 100 of a preferred embodiment has a center panel 110, a right panel 120 and a left panel 130. The right and left panels 120, 130 each are connected to the center panel 110 by a connecting element 300. In a preferred embodiment, right, left, and center panels are forms integrally from a semi-rigid plastic material and the connecting elements 300 are formed by rounded grooves in the plastic material. The rounded grooves permit the left and right panels to be folded in one direction toward the center panel but resist folding of the right and left panels in an opposite direction. The right and left panels each have a base edge 122, 132, an angled top edge 124, 134 and a retention element 126, 136. When the easel is in use, the base edges 122, 132 are placed on a flat surface. The angle top edges 124, 134 provide support for an object such as a display binder, and the retention elements 126, 136 each have a portion that is substantially perpendicular to said angled top edges 124, 134 and thereby retain the object on the easel.

The center panel 110 has a top side or edge 114 and a bottom edge or side 112. The top side 114 has a plurality of engagement elements 200 extending from it. As shown in FIGS. 2A-D, each engagement element 200 is formed from a left tab 210, a right tab 220 and a pair of central tabs 230. The left tab has a straight outer side 212, a straight top side 214, a straight inner side 216 and a neck portion 218. The corners between the outer side 212 and the top side 214 and between the top side 214 and the inner side 216 preferable are rounded. Each central tab 230 has straight right and left sides 232, 234, a straight top side 236 and neck portions 238. Again, the corners preferably are rounded. The right tab 220 has a form that is the inverse of left tab 210. In between each pair of tabs, there is formed a channel 250 and a receptacle 240.

The straights sides on the tabs that are opposing one another preferable are angled slightly toward one another to provide increased resistance as a ring of a binder is inserted between the tabs until the ring is past the channel and in the receptacle. The tab corners, edges or ridges between the straight sides and the neck portions provide a retention mechanism to prevent unintended released of the easel from a binder.

Figure 5:
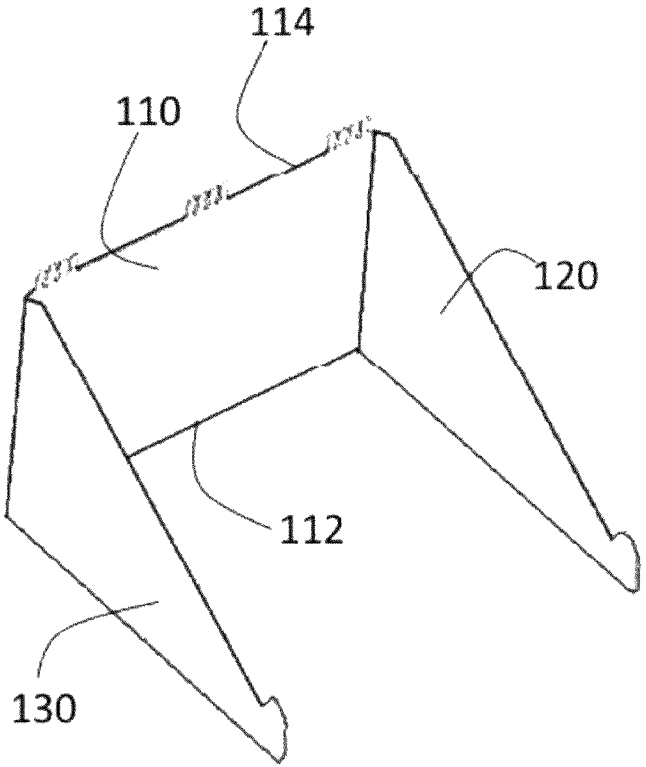
FIG. 5 is a perspective view of an easel in accordance with a preferred embodiment of the present invention with its side panels extended to supporting positions.
Figure 4:
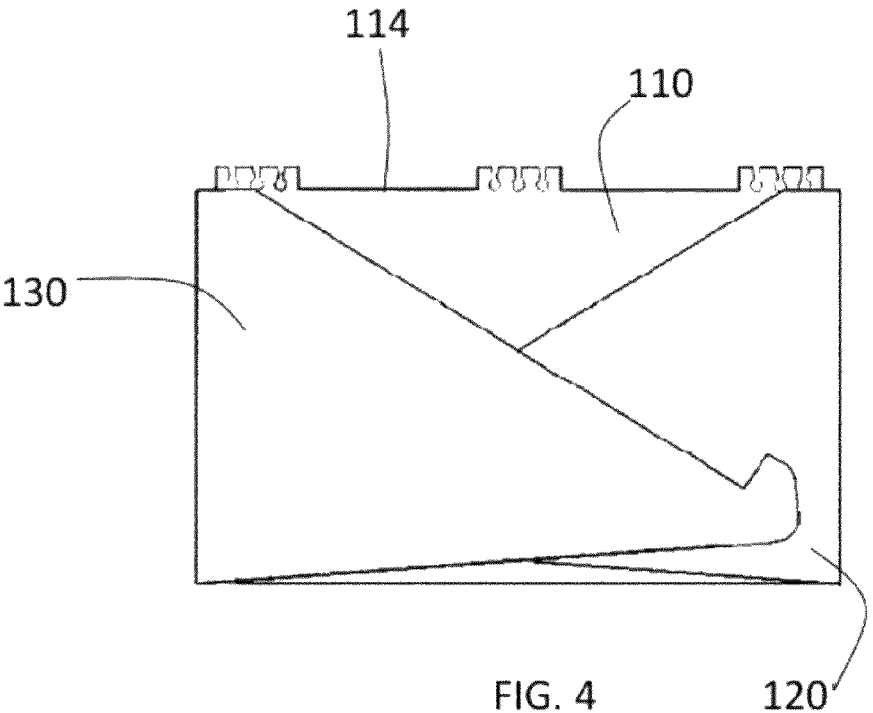
FIG. 4 is a front view of an easel in accordance with a preferred embodiment of the present invention with its side panels in a fully closed or folded position.
Figure 6:
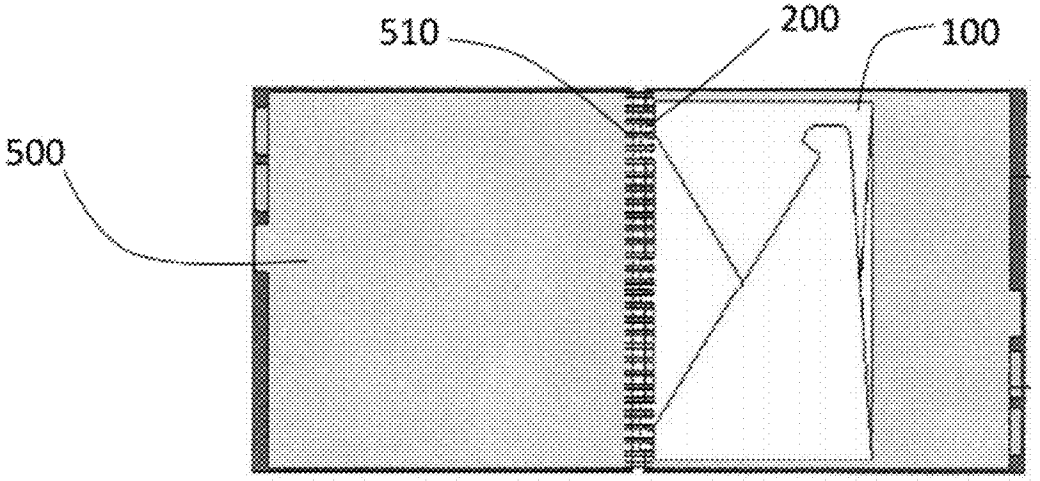
FIG. 6 is a front view of an open binder having an easel in accordance with a preferred embodiment of the present invention inserted into the binder in a folded position.
Figure 7:
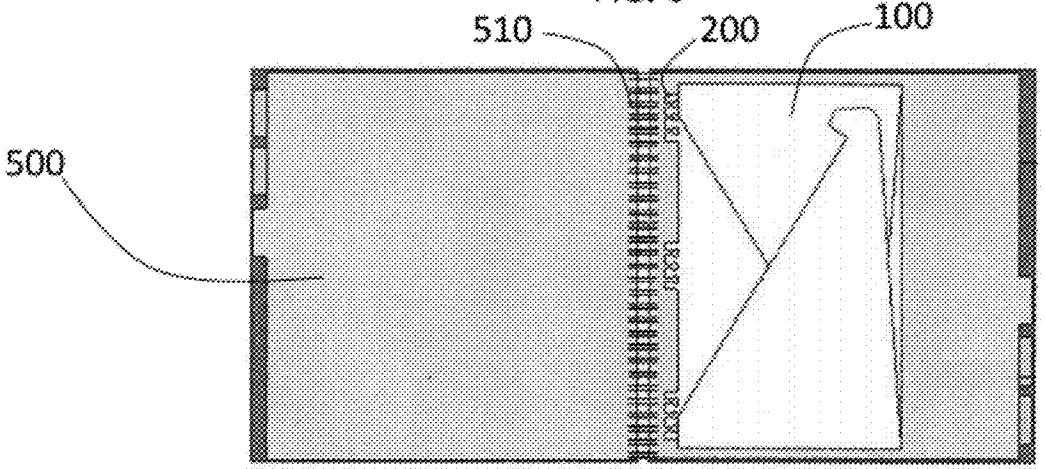
FIG. 7 is a front view of an open binder having an easel in accordance with a preferred embodiment of the present invention begin inserted into the binder in a folded position.

When in use, the right and left panels of the easel are paced at approximately right angles to the center panel, as shown in FIG. 5. In this configuration, a display binder may be placed upon the easel such that is rests on the angled top edges of the right and left panels and on the engagement element on the top side or each of the center panel. When not in use, the right and left panels may be folded inward, as is shown in FIG. 4 such that one of the right and left sides is approximately flush against the center panel. In the folded configuration, the easel may be inserted into a display binder as shown in FIGS. 6 and 7. The easel is inserted such that the tabs engage with the binder rings. The easel is pressed into the binder such that the binder rings proceed through the channels between the tabs and into the receptacles. While three sets of tabs are shown in the preferred embodiment, other arrangements are of course possible.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A folding display easel comprising:

a left panel having a base side, right side at substantially a right angle to said base, a top side having a first portion at substantially a right angle to said right side and a second portion angling toward said base side, and a left side having a retention element;

a right panel having a base side, left side at substantially a right angle to said base, a top side having a first portion at substantially a right angle to said left side and a second portion angling toward said base side, and a right side having a retention element;

a center panel having a base side, a left side, a right side, a top side, a front face and a rear face;

a first connecting element connecting said right side of said left panel to said left side of said center panel, said first connecting element permitting said left panel to fold toward said front face of said center panel and resisting said left panel folding toward said rear face of said center panel;

a second connecting element connecting said left side of said right panel to said right side of said center panel, said second connecting element permitting said right panel to fold toward said front face of said center panel and resisting said right panel folding toward said rear face of said center panel;

a first engagement element formed integrally with said top side of said center panel, wherein said first engagement element engages with a ring when said easel is placed in a ring binder; and a second engagement element formed integrally with said top side of said center panel, wherein said first engagement element being detachably connected with a ring when said easel is placed in a ring binder;

wherein said easel has a folded position in which a first of said right and left panels is folded to a position adjacent said front face of said center panel and a second of said right and left panels is folded to a position adjacent said first of said right and left panels and said easel has a support position in which said right and left panels are partially folded to positions placing said right and left panels at approximately right angles with said center panel to support a binder resting upon said second portions of said top sides of said right and left panels and retained on said second portions by said retention elements on said right and left panels.

2. A folding display easel according to claim 1, wherein said first engagement element comprises:

a plurality of tabs extending from top side of said center panel, wherein said plurality of tabs comprises:

a first tab having a neck portion and a tip portion, said tip portion being larger than said neck portion;

a second tab having a neck portion and a tip portion, said tip portion being larger than said neck portion;

a third tab having a neck portion and a tip portion, said tip portion being larger than said neck portion; and wherein said second tab is between said first tab and said third tab and wherein said first and second tab tips form a channel and said first and second tab necks form a receptacle connected to said channel, said channel being larger than said receptacle.

3. A folding display easel according to claim 2, wherein said first tab tip and said second tab tip have straight edges facing one another, wherein said straight edges form said channel.

4. A folding display easel according to claim 3, wherein said straight edges of said first tab tip and said second tab tip are not parallel to one another.

5. A folding display easel according to claim 4, wherein said channel formed by said straight edges of said first tab tip and said second tab tip extends away from said receptacle and said channel becomes narrower as it becomes closer to said receptacle.

6. A folding display easel according to claim 2, wherein said second engagement element comprises:

a plurality of tabs spaced apart from said first engagement element and extending from top side of said center panel, wherein said plurality of tabs comprises:

a first tab having a neck portion and a tip portion, said tip portion being larger than said neck portion;

a second tab having a neck portion and a tip portion, said tip portion being larger than said neck portion;

a third tab having a neck portion and a tip portion, said tip portion being larger than said neck portion; and wherein said second tab is between said first tab and said third tab and wherein said first and second tab tips form a channel and said first and second tab necks form a receptacle connected to said channel, said channel being larger than said receptacle.

7. A folding display easel according to claim 2, wherein said plurality of tabs further comprises a fourth tab, said third tab being between said second tab and said fourth tab.

8. A folding display easel according to claim 6, further comprising:

a third engagement element formed integrally with said top side of said center panel, wherein said first engagement element engages with a ring when said easel is placed in a ring binder.

9. A folding display easel according to claim 6, wherein said third engagement element comprises:

a plurality of tabs spaced apart from said first engagement element and extending from top side of said center panel, wherein said plurality of tabs comprises:

a first tab having a neck portion and a tip portion, said tip portion being larger than said neck portion;

a second tab having a neck portion and a tip portion, said tip portion being larger than said neck portion;

a third tab having a neck portion and a tip portion, said tip portion being larger than said neck portion; and wherein said second tab is between said first tab and said third tab and wherein said first and second tab tips form a channel and said first and second tab necks form a receptacle connected to said channel, said channel being larger than said receptacle.

* * * * *